US005564134A

United States Patent [19]

Ruth

[11] Patent Number: 5,564,134

[45] Date of Patent: Oct. 15, 1996

[54] TRANSPORTABLE APPARATUS AND METHOD FOR SANITIZING TOILET SEATS

[76] Inventor: Solomon J. Ruth, 15103 Quail Rock Cir., Houston, Tex. 77095

[21] Appl. No.: 424,400

[22] PCT Filed: Oct. 22, 1992

[86] PCT No.: PCT/US92/09224

§ 371 Date: Apr. 20, 1995

§ 102(e) Date: Apr. 20, 1995

[87] PCT Pub. No.: WO94/08499

PCT Pub. Date: Apr. 28, 1994

Related U.S. Application Data

[63] Continuation-in-part of Ser. No. 698,451, May 10, 1991, Pat. No. 5,175,890.

[51] Int. Cl.[6] ..... E03D 9/00

[52] U.S. Cl. ..... 4/233; 4/300.1; 4/420.4; 222/181.2; 222/192

[58] Field of Search ..... 4/222, 233, 300.1, 4/300.2, 443–448, 420.1, 420.2, 420.4; 222/181.2, 192

[56] References Cited

U.S. PATENT DOCUMENTS

| | | | |
|---|---|---|---|
| 3,776,773 | 12/1973 | Taft | 4/300.1 X |
| 5,379,813 | 1/1995 | Ing | 222/181.2 X |
| 5,379,917 | 1/1995 | Brown et al. | 222/181.2 X |
| 5,435,465 | 7/1995 | El-Amin | 222/192 X |

FOREIGN PATENT DOCUMENTS

| | | | |
|---|---|---|---|
| 2669205 | 5/1992 | France | 222/192 |

*Primary Examiner*—Charles E. Phillips

[57] ABSTRACT

A sanitizing method and device for toilet facilities, comprising a liquid dispenser containing a liquid disinfectant, tissue dispenser and spray gun. The sanitizing device operation upon a toilet seat is initiated by removal of the spray gun and dispersement of disinfectant about the perimeter of a toilet seat followed by the application of tissue about the same perimeter removing the disinfectant and the disposal of the tissue and disinfectant into the toilet.

2 Claims, 9 Drawing Sheets

TRANSPORTABLE APPARATUS AND METHOD FOR SANITIZING TOILET SEATS

This application is a continuation in part of U.S. application Ser. No. 07/698,451 filed May 10, 1991, now U.S. Pat. No. 5,175,890.

BACKGROUND OF THE INVENTION

This invention relates to a method and apparatus for sanitizing toilet seats. The invention is capable of being installed either adjacent to the toilet on a fixed surface or on the tank of the commode or toilet. The method apparatus is compatible with all temporary or portable toilets, such as the type housed in temporary housings at construction sites, and with all stationary non-mobile toilets.

Traditionally, there has been general public concern regarding the sanitization of public and private toilet seats and surrounding fixtures. The prior art discloses attempts at solving this problem through the often highly technical apparatuses employed for the simple purpose of disinfecting toilet seats. Disclosures of these types are found in U.S. Pat. No's. 3,171,135; 3,199,739; 4,790,039; 4,924,532; 3,599,246; 4,790,036; 3,815,158; 3,988,788; 3,837;018; 4,03,316; 4,183,105; 4,536,899; 4,242,764; 4,873,739; 4,734,942; 4,745,639; 4,729,133; 4,873,728; 4,769,859; 4,910,815; 4,766,617; 4,566,648; 4,412,360; 4,806,406; and German patent 3101761A1 and French brevet 1,053,053.

For reasons unknown, many of these devices have not been publicly implemented, perhaps due to the complexities, cost ineffectiveness and lack of practicalities in the use of these devices.

Generally, the prior art of record relates to highly technical and mechanical apparatuses that would not and could not be used for applications in other than a single stationary toilet or toilets of singular design. Further, the prior art of record demonstrates the need for the construction of, and adaptation of sanitizing devices to the toilet seat base and tank such that the sanitizing devices could be easily transferred from one location, and design, to another. Thus, one object of the present invention avails the sanitizing device to be attached and used to either the toilet tank or adjacent wall and could be transferred from facility to facility.

More specifically, U.S. Pat. No's. 4,873,728 and 4,790,039 demonstrate a transferable sanitizing device which may be implemented on various toilets, stationary or non-stationary. However, the primary embodiment of the present invention demonstrates simplicity in design and function over prior art patents and is more cost effective and easier to use. Additionally, the present invention demonstrates a method of removal of the sanitizing liquid from the surface perimeter of the toilet seat which is not disclosed or suggested by the 4,790,039 Patent. Also, an object of the present invention discloses a more sanitary condition than the 4,873,728 Patent, which houses the disinfectant and sanitizing wipe in the same container, resulting in unsanitary conditions within the container unless the dispensing tissue is removed after each use. The prior art thus demonstrates the need for a modular transferable sanitizing device for toilets that is cost effective and more sanitary in its use, such as Applicant's invention. Other objects and advantages of this invention will become more fully apparent below, reference being made to the accompanying drawing and appended claims.

DETAILED DESCRIPTION OF THE PREFERRED EMBODIMENT

Figure 1:
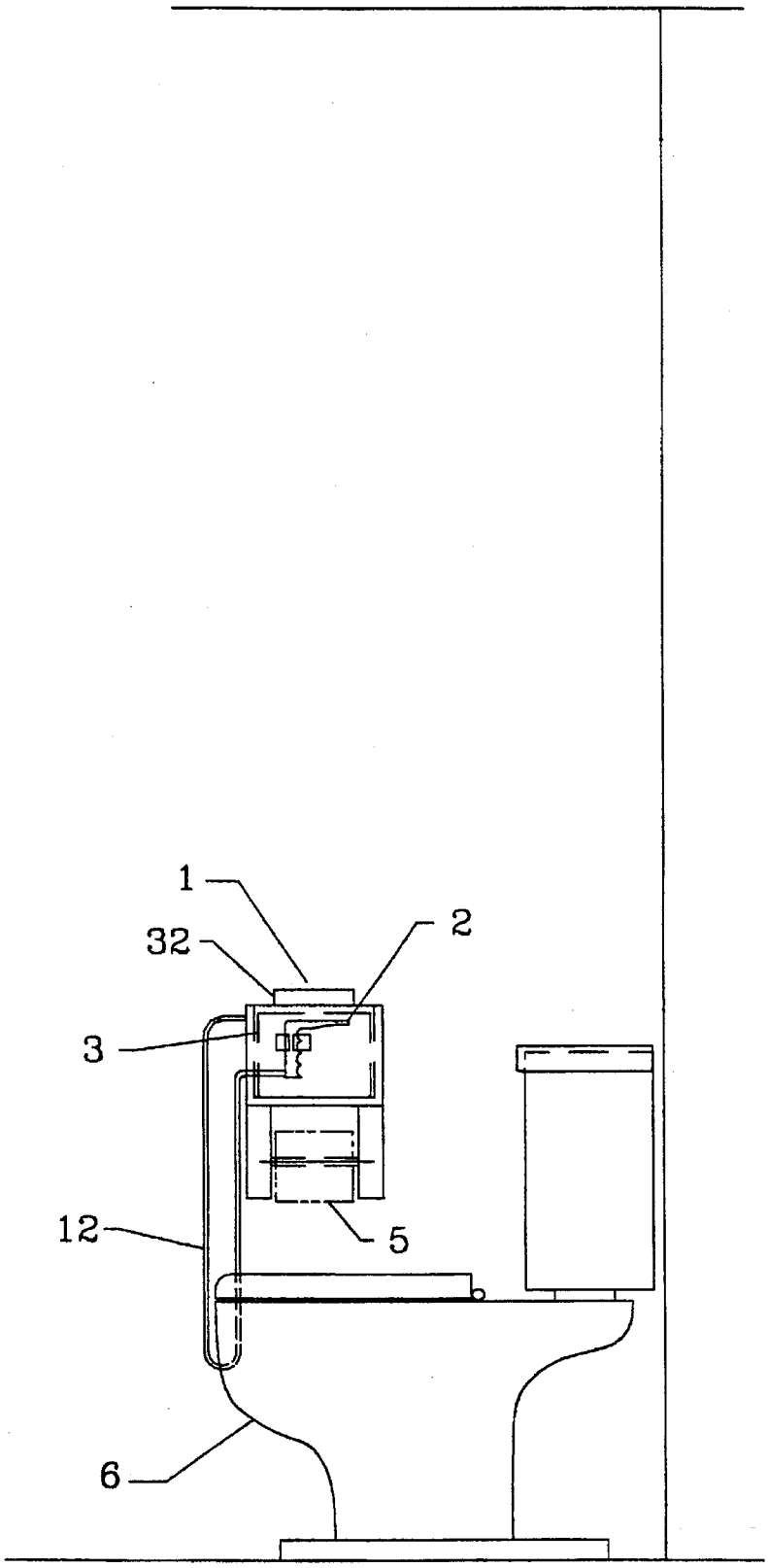
FIG. 1 is a front elevational view demonstrating one embodiment of the sanitizing device.

Referring now to the drawings of FIG. 1, there is illustrated a toilet 6 and sanitizing device 1 which houses and holds the disinfectant spray gun 2, sanitizing liquid dispenser 3, sanitizing liquid exchanger hose 12, and disinfectant tissue roll 5.

Figure 2:
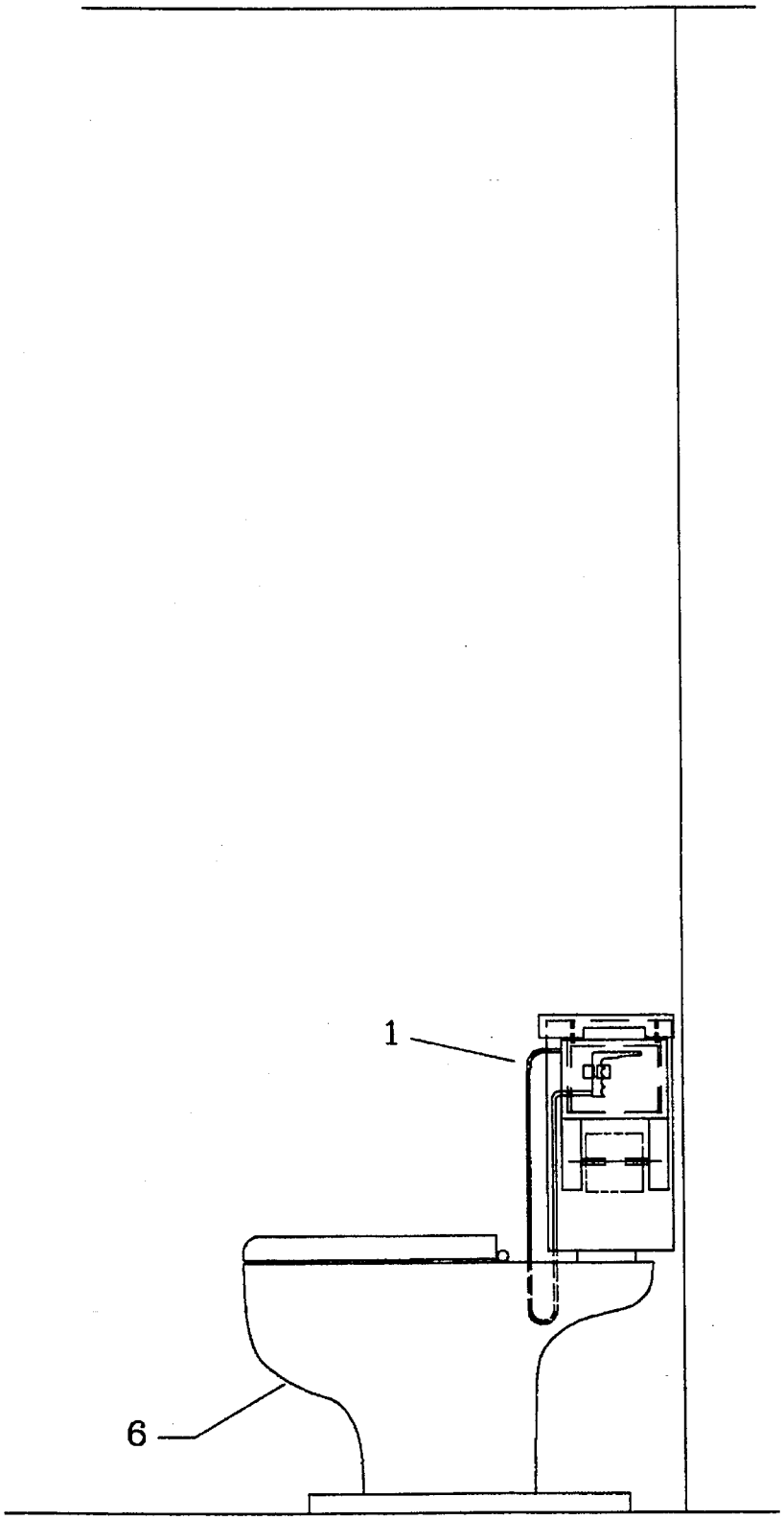
FIG. 2 is a front elevational view demonstrating an alternative embodiment of the sanitizing device.
Figure 3:
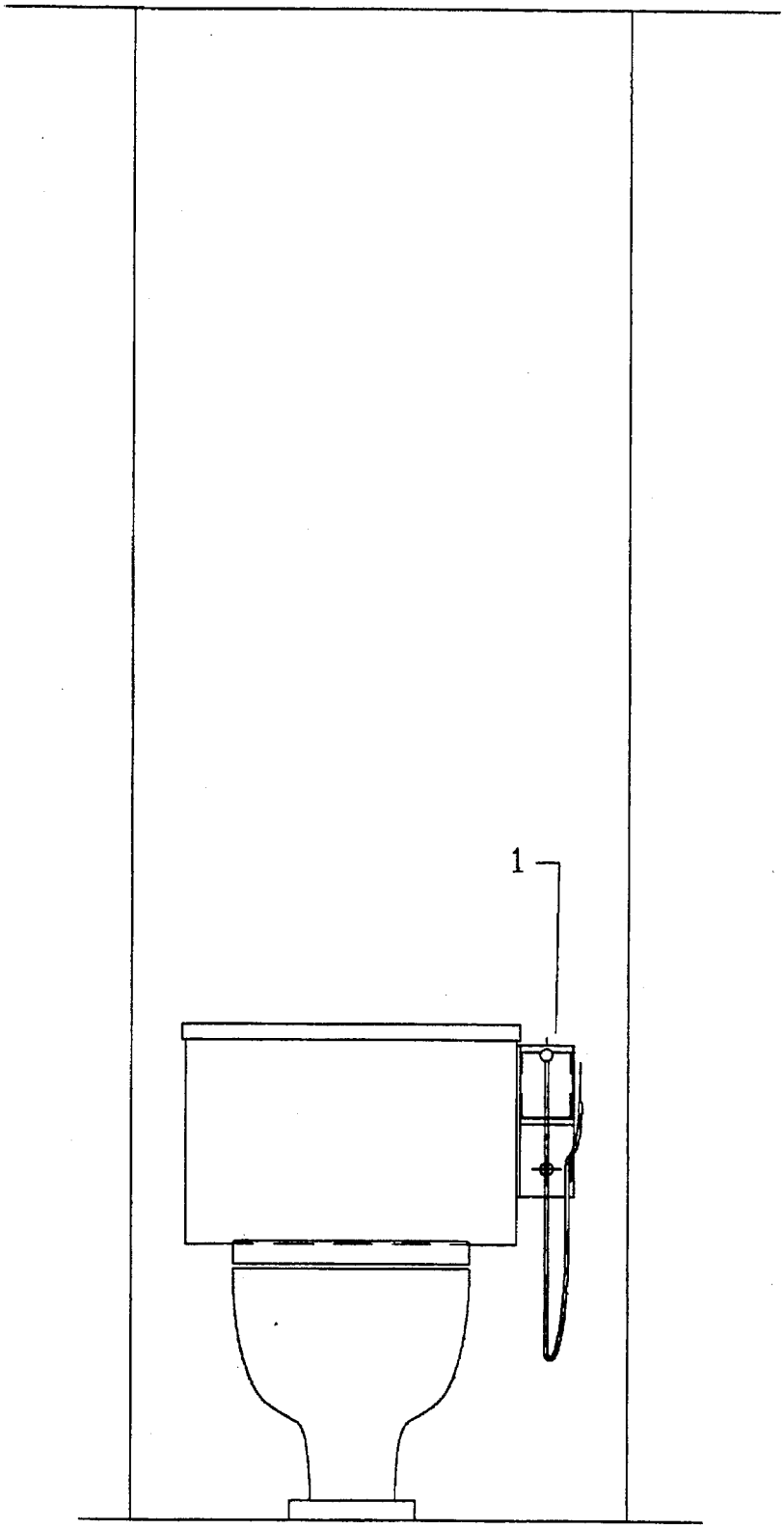
FIG. 3 is a side view for the sanitizing device.

FIG. 2 demonstrates an alternative embodiment of the present invention attached to the toilet 6 at 1.

Figure 4:
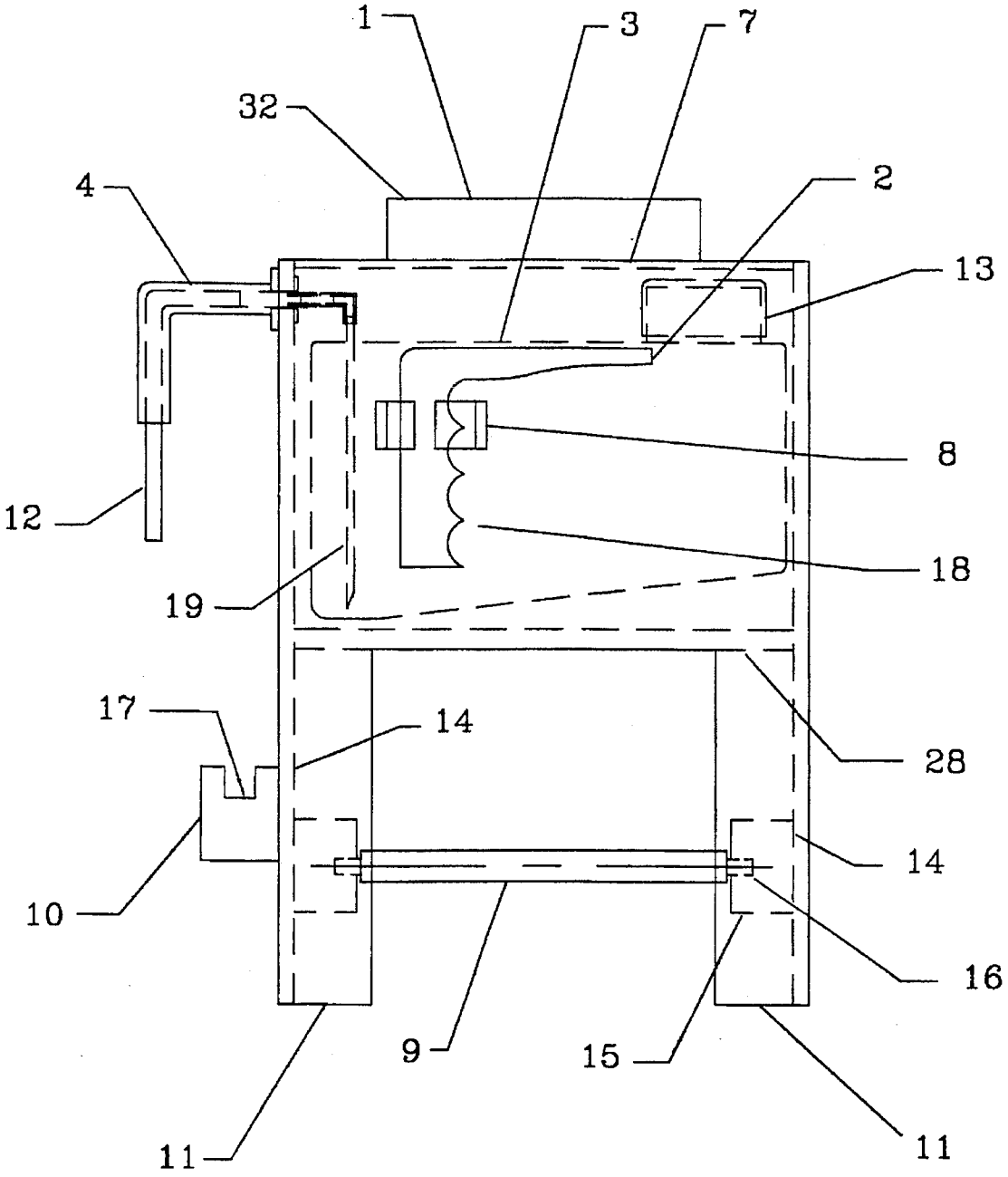
FIG. 4 is a front elevational cut-away of the sanitizing device.

FIG. 4 demonstrates the sanitizing device 1 comprising a liquid dispenser housing 7 and liquid dispenser 3 enclosed by liquid dispenser cap 13. The liquid dispenser 3 contains a bracket 8 longitudinally placed on the side of the liquid dispenser 3, capable of securing and fastening the liquid dispensing spray gun 2. The liquid dispensing spray gun 2 contains a handle 18 which at its lower most end is connected a hose 12 (connection not pictured). The liquid dispensing hose 12 is insulated by insulation means 4 which may be made of any common rubber insulation. A robe 19 leads into the liquid dispenser 3 in order to enable the transfer of sanitizing liquid from the liquid dispenser 3 to 2, spray gun nozzle. At the lower most end of the sanitizing device 28 is a housing for the tissue dispenser which is enclosed by walls 11 and 14. The tissue dispenser housing comprises a roller 9 connected at 16 to support 15 which is attached to wall 14. Hose 12 may be secured and fastened by bracket 10 at groove 17.

Figure 5:
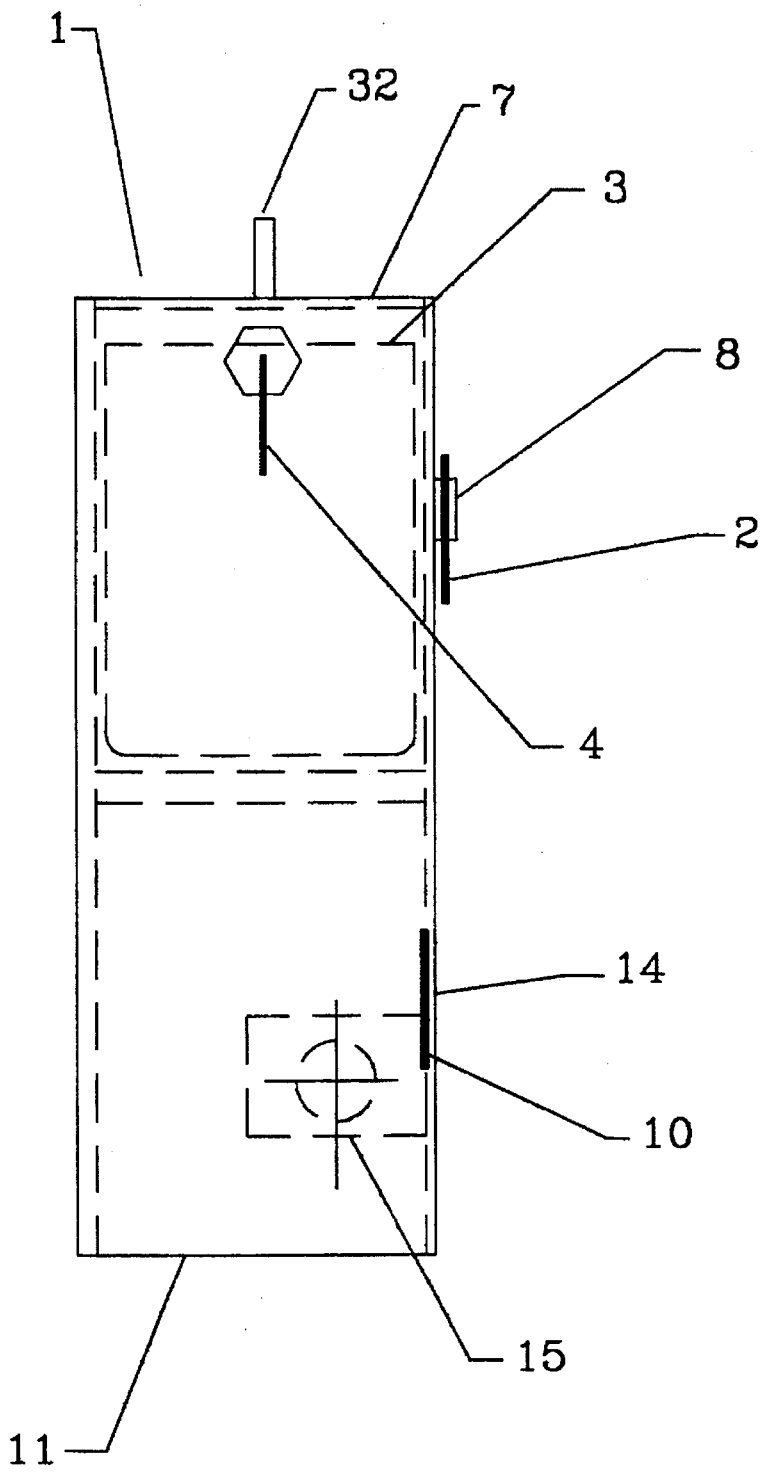
FIG. 5 is a side elevational cut away of the sanitizing device.

FIG. 5 demonstrates a side elevational cut-away of the sanitizing device 1 with a lid 33 opening into housing 7 for the liquid dispenser 3. A liquid dispensing hose 4 may be adjustable and securely connected at bracket 10. Attached to the liquid dispenser housing 7 is an exterior bracket 8 for holding dispensing spray gun 2. Lower housing 14 contains a lower most housing 11 and tissue dispensing and support 15.

Figure 6:
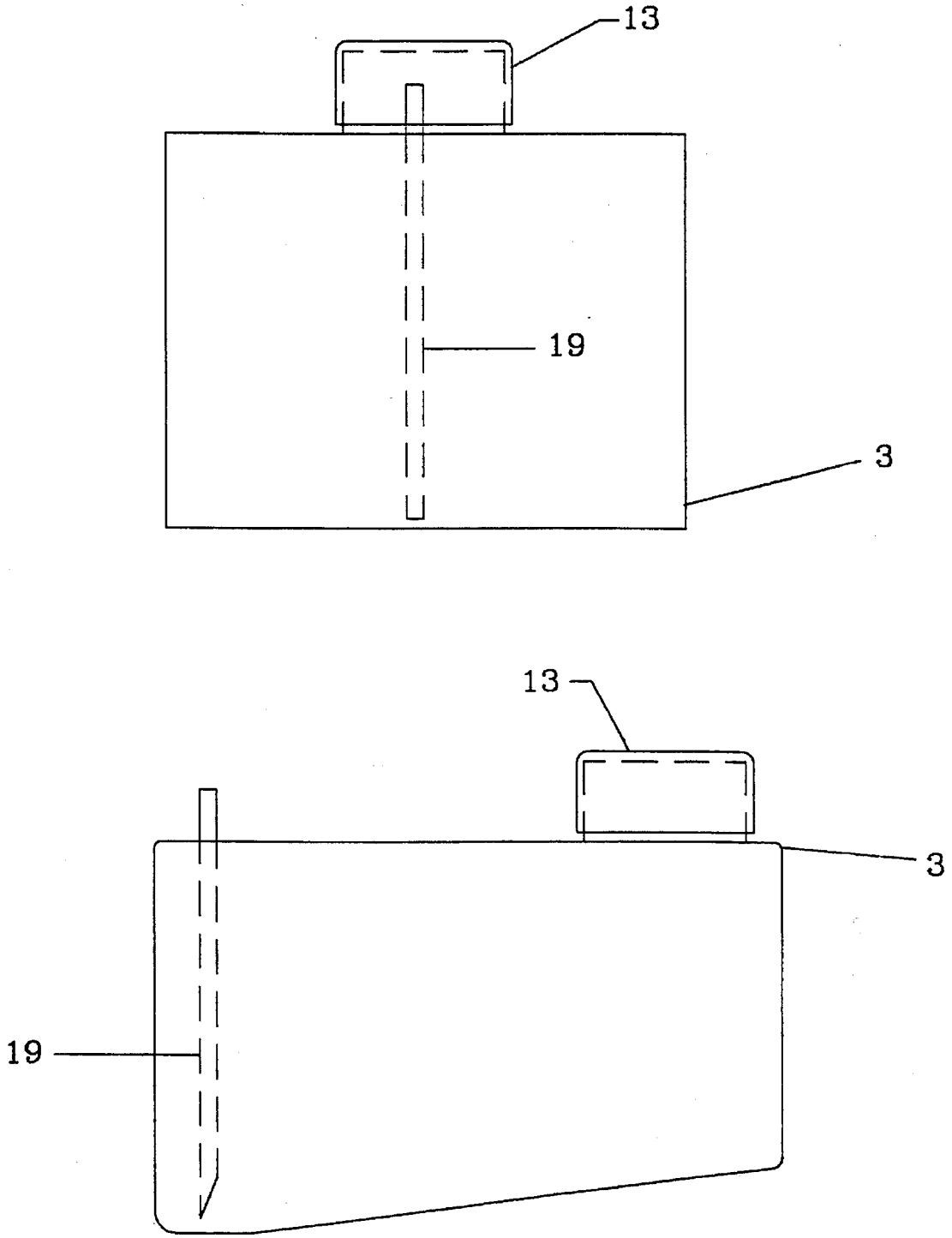
FIG. 6 is a front and side cut-away of the liquid dispenser.

Referring now to FIG. 6, a front and side elevational of the liquid dispenser 3 is pictured containing cap 143 and robe 19 used to transfer the sanitizing liquid from the liquid dispenser 3 into hose 4.

Figure 7:
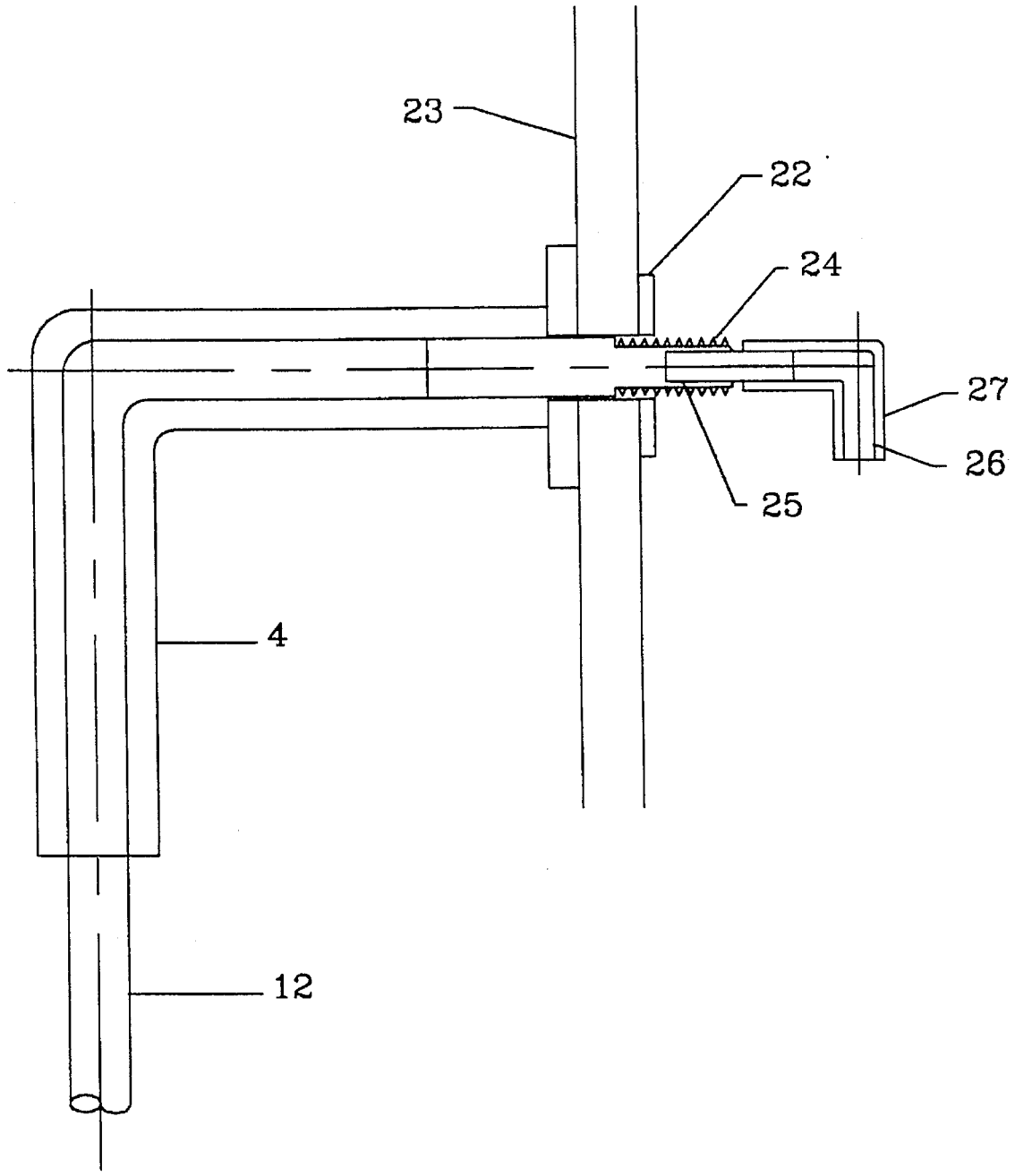
FIG. 7 is a side cut-away of the dispensing hose.

FIG. 7 is an elevational cut-away of the liquid dispenser 3 which comprises a side wall housing 23, insulating hose 4, and robe 12 extending into the liquid dispenser 3 at 24. Connection means 26 is used to join tube 19 and robe 12, and is insulated by insulation means 27 wherein the connection means 26 terminates at 25 leading into a securing means 24, used to secure the insulating and tube means at 22.

Figure 8:
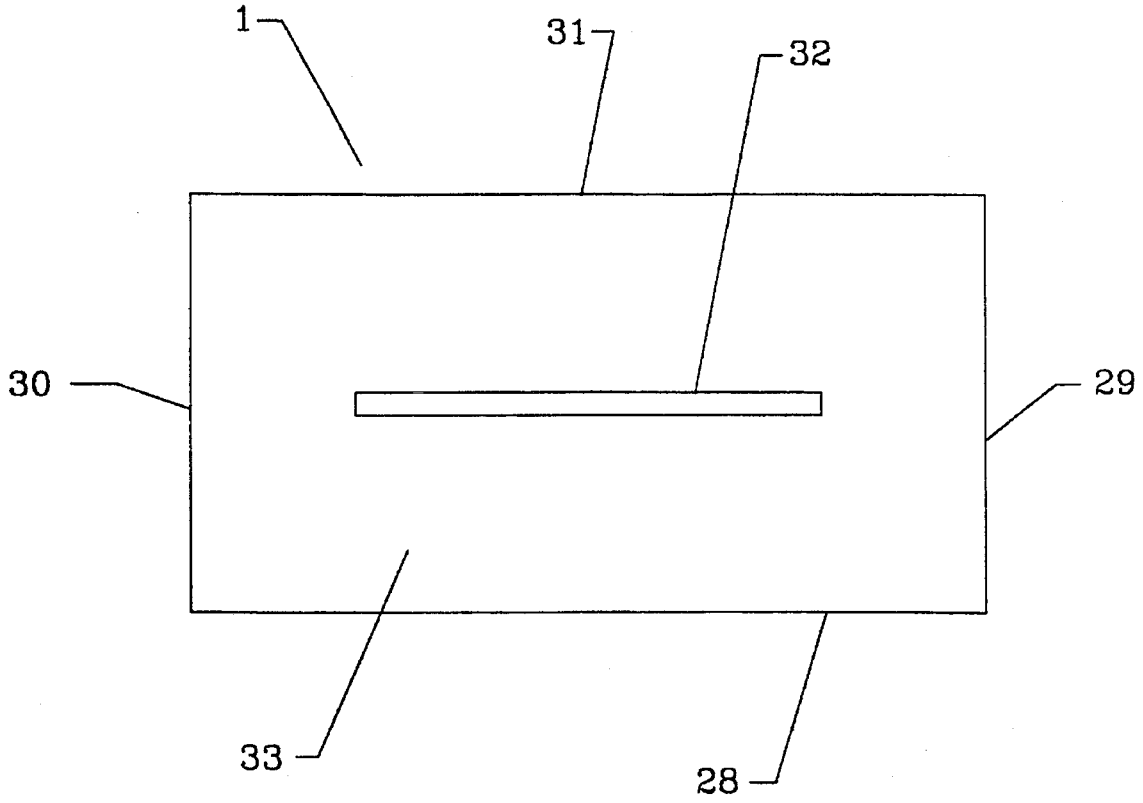
FIG. 8 is a top view of the sanitizing device.

Referring now to FIG. 8, a top view of the liquid sanitizing device 1 demonstrates the perimeter boundaries 28, 29, and 30 and 31 of the sanitizing device which is removable allowing entrance and replacement of liquid dispenser 3 by handle 32 to remove the lid.

Figure 9:
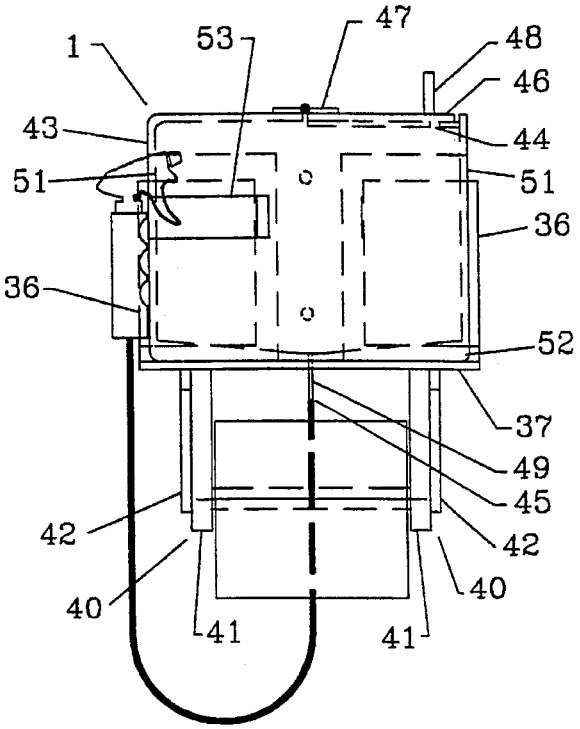
FIG. 9 is a front elevational cut-away of an alternative embodiment of components of the liquid dispenser
Figure 10:
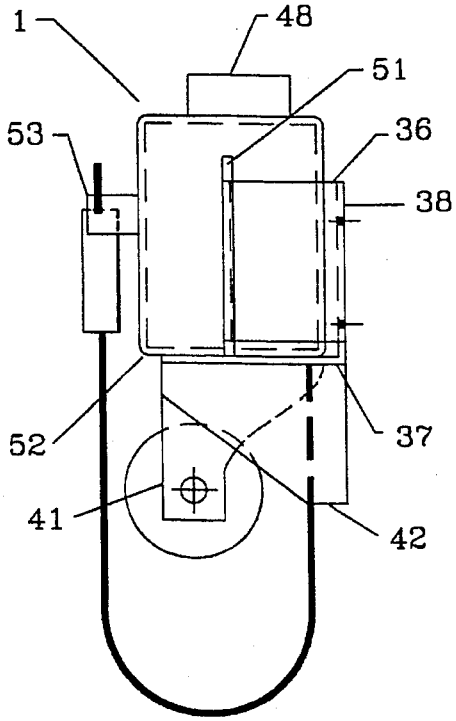
FIG. 10 is a side cut-away of the FIG. 9 embodiment of the device.
Figure 11:
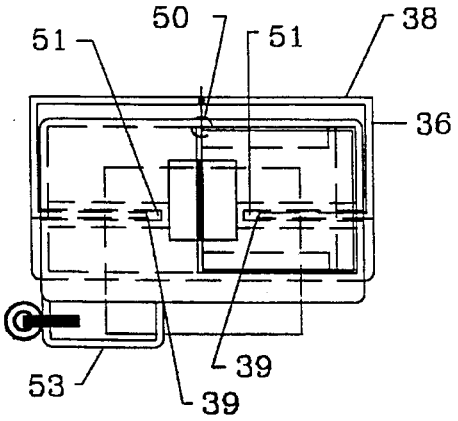
FIG. 11 is a top ghost view of the embodiment of FIGS. 9 and 10.

Referring now to FIGS. 9, 10 and 11, there will be described an alternative embodiment of the present invention. References to components that are identical to those used in the previous embodiment will be referred to by like reference numerals.

FIG. 9 is a front elevational cutaway of the alternative embodiment. FIG. 9 illustrates components analogous to those in FIG. 4 without including the liquid dispenser 3 and spray gun 2, which would be similar for both embodiments.

The sanitizing device 1 illustrated in the embodiment of FIG. 9 comprises a housing 35 and a liquid container 43. As illustrated in FIGS. 9, 10 and 11, alternative views of this alternate embodiment, the housing 35 comprises side walls 36, a floor 37 with an opening 50, a back wall 38 front wings 39 and wall extensions 40 below the floor. The extensions 40 further comprise tissue mounts 41 and wall braces 42.

The liquid container 43 is provided with two openings in the embodiment illustrated, a top opening 44 and a lower opening 45. The top opening 44 is provided with a cover 46 which may be hinged as at location 47 in the illustrated embodiment or which may be otherwise secured to the liquid container 43. The hinged cover 46 provided with a handle 48. The lower opening 45 is provided with an extension to 49 which passes through an opening 50 in the floor 37 of the housing 35 when the liquid container is installed within said housing.

This alternative embodiment of liquid container 43 is adapted to be installed within the housing 35 by means of forming the external dimensions of the liquid container 43 to fit between the side walls 36 of the housing, 35 in combination with side slots 51 provided along the sides of the liquid container 43 which conform to the shape and location of the front wings 39 of the housing 35. Thus, the liquid container is installed within the housing by aligning the front wings 39 of the housing 35 with the side slots 51 of the liquid container 43 and then sliding the container 43 down within the housing until the floor 52 of the liquid container rests upon the floor 37 of the housing with the extension tube 49 extending from the floor of the container through the aperture 50 within the floor of the housing. A fluid conduit or tube is connected to this extension 49 and then to a spray gun in a similar manner to that described for the earlier embodiment with its fluid conduit 12 and spray gun 2. As illustrated best in FIG. 9 the liquid container of this alternative embodiment is preferably molded so that the interior floor of the container provides a sloped draining surface converging on the aperture 45 to allow disinfectant solution to drain towards the aperture.

A mounting bracket 53 is provided for the spray gun means 2 although in this alternate form the bracket is mounted to the liquid container rather than the housing. In this alternative embodiment, the bracket 53 can serve the dual function of a mounting bracket for the liquid dispensing gun and a handle conveniently used to help remove the liquid container 43 from the housing 35. A sanitizing device is mounted to the wall of the toilet facility or to the toilet fixture itself by any suitable attachment means or adhesive through or upon the back wall 38 and the housing. The liquid container can be tided with a suitable antiseptic, hygienic or cleaning solution or germicide. The invention thus provides convenient and ready source of materials for cleaning public toilet facilities. Before the toilet is used, the liquid from the container is applied to any surfaces desired to be cleaned by means of the spray gun. The liquid is then removed from the services by using tissue from the attached dispenser and then the tissue and liquid is disposed of down the toilet facilities.

Since many possible embodiments may be made of the invention without departing from the scope thereof, it is to be understood that all matters herein set forth or shown in the accompanying are to be interpreted as illustrative and not in a limiting sense per view of the invention as specified in the appended claims.

I claim:

1. A toilet seat sanitizing device including means for mounting said device for installation and use with a single toilet providing for an individual users satisfactory cleaning of said toilet seat, said device comprising:

(a) a housing adapted to be mounted on a bathroom wall, said housing comprising two side walls, a floor with a passage there through, a back wall, front wings, and extensions below said floor of said housing wherein said extensions form means extended below said floor of said housing for mounting means for dispensing tissues and form means for bracing said housing against said bathroom wall;

(b) a liquid container provided with a first aperture and a top adapted for combination and covering engagement with said container over said first aperture, wherein said container and top combination is provided with a second aperture and wherein said container is configured for installation within said housing, confined by said backwall, floor, side walls and said wings;

(c) liquid dispensing means comprising a spray gun, a fluid conduit and an extension, wherein said extension comprises a tube extending from said fluid container at said second aperture through said passage in said floor to provide fluid communication from said container through said housing to said spray gun via said conduit and wherein said fluid conduit provides fluid communication for the length required for application of a liquid from said container through said spray gun to said toilet seat; and (d) a mounting bracket on said liquid container, said bracket adapted to removably secure said spray gun to said container.

2. The invention of claim 1 wherein said mounting means comprises means for mounting a roller bar and wherein said tissue dispensing means comprises a roll of tissue paper adapted for mounting to said roller bar.

* * * * *